US006561206B1

(12) United States Patent
Wilkinson

(10) Patent No.: US 6,561,206 B1
(45) Date of Patent: May 13, 2003

(54) CRUTCH COUPLING SYSTEM

(76) Inventor: Christopher M. Wilkinson, The Hall, Norton Disney, Lincolnshire LN6 9JP (GB)

( * ) Notice: Subject to any disclaimer, the term of this patent is extended or adjusted under 35 U.S.C. 154(b) by 6 days.

(21) Appl. No.: 09/922,291

(22) Filed: Aug. 3, 2001

(51) Int. Cl.[7] ..... A45B 1/00

(52) U.S. Cl. ..... 135/65; 135/67; 135/68; 248/206.5; 248/316.7; 248/67.7; 248/68.1; 211/62

(58) Field of Search ..... 248/206.5, 316.7, 248/683, 67.7, 68.1; 211/62; 335/285; 135/65, 67, 68

(56) References Cited

U.S. PATENT DOCUMENTS 2,702,683 A * 2/1955 Green et al.
2,964,812 A * 12/1960 Cook
3,111,736 A 11/1963 Budreck
3,746,177 A * 7/1973 Vilotti
3,985,148 A 10/1976 Cadman
4,605,190 A * 8/1986 Kamp ..... 248/316.7
4,837,666 A 6/1989 Conkle
4,995,655 A * 2/1991 Freeman ..... 292/251.5
5,255,800 A * 10/1993 Kelly
5,360,190 A * 11/1994 Walker et al.
5,392,800 A 2/1995 Sergi
5,456,437 A 10/1995 Chander et al.
5,573,025 A * 11/1996 Atlas ..... 135/65
5,577,697 A * 11/1996 Accordino
D378,531 S 3/1997 Szikszay
5,664,713 A 9/1997 Burgstahler

* cited by examiner

*Primary Examiner*—Robert Canfield

(57) ABSTRACT

A crutch coupling system for holding two crutches in a static relationship with respect to each other. The crutch coupling system includes a first coupling assembly, which is connected to a first walking aid and provides a magnetic force for facilitating the coupling of a pair of walking aids; and a second coupling assembly, which is similarly connected to a second walking aid and is magnetically attracted to the first coupling assembly such that the second coupling assembly is selectively couplable to the first coupling assembly when the first and second coupling assemblies are in close physical proximity.

19 Claims, 3 Drawing Sheets

CRUTCH COUPLING SYSTEM

BACKGROUND OF THE INVENTION

1. Field of the Invention

The present invention relates to magnetic connectors and more particularly pertains to a new crutch coupling system for holding two crutches in a static relationship with respect to each other.

2. Description of the Prior Art

The use of magnetic connectors is known in the prior art. More specifically, magnetic connectors heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,111,736; U.S. Pat. No. 5,456,437; U.S. Pat. No. 5,664,713; U.S. Pat. No. 4,837,666; U.S. Pat. No. 5,392,800; U.S. Pat. No. 3,985,148; and U.S. Pat. No. Des. 378,531.

While these devices fulfill their respective, particular objectives and requirements, the aforementioned patents do not disclose a new crutch coupling system. The inventive device includes a first coupling assembly, which is connected to a first walking aid and provides a magnetic force for facilitating the coupling of a pair of walking aids; and a second coupling assembly, which is similarly connected to a second walking aid and is magnetically attracted to the first coupling assembly such that the second coupling assembly is selectively couplable to the first coupling assembly when the first and second coupling assemblies are in close physical proximity.

In these respects, the crutch coupling system according to the present invention substantially departs from the conventional concepts and designs of the prior art, and in so doing provides an apparatus primarily developed for the purpose of holding two crutches in a static relationship with respect to each other.

SUMMARY OF THE INVENTION

In view of the foregoing disadvantages inherent in the known types of magnetic connectors now present in the prior art, the present invention provides a new crutch coupling system construction wherein the same can be utilized for holding two crutches in a static relationship with respect to each other.

The general purpose of the present invention, which will be described subsequently in greater detail, is to provide a new crutch coupling system apparatus and method which has many of the advantages of the magnetic connectors mentioned heretofore and many novel features that result in a new crutch coupling system which is not anticipated, rendered obvious, suggested, or even implied by any of the prior art magnetic connectors, either alone or in any combination thereof.

To attain this, the present invention generally comprises a first coupling assembly, which is connected to a first walking aid and provides a magnetic force for facilitating the coupling of a pair of walking aids; and a second coupling assembly, which is similarly connected to a second walking aid and is magnetically attracted to the first coupling assembly such that the second coupling assembly is selectively couplable to the first coupling assembly when the first and second coupling assemblies are in close physical proximity.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new crutch coupling system apparatus and method which has many of the advantages of the magnetic connectors mentioned heretofore and many novel features that result in a new crutch coupling system which is not anticipated, rendered obvious, suggested, or even implied by any of the prior art magnetic connectors, either alone or in any combination thereof.

It is another object of the present invention to provide a new crutch coupling system which may be easily and efficiently manufactured and marketed.

It is a further object of the present invention to provide a new crutch coupling system which is of a durable and reliable construction.

An even further object of the present invention is to provide a new crutch coupling system which is susceptible of a low cost of manufacture with regard to both materials and labor, and which accordingly is then susceptible of low prices of sale to the consuming public, thereby making such crutch coupling system economically available to the buying public.

Still yet another object of the present invention is to provide a new crutch coupling system which provides in the apparatuses and methods of the prior art some of the advantages thereof, while simultaneously overcoming some of the disadvantages normally associated therewith.

Still another object of the present invention is to provide a new crutch coupling system for holding two crutches in a static relationship with respect to each other.

Yet another object of the present invention is to provide a new crutch coupling system which includes a first coupling assembly, which is connected to a first walking aid and provides a magnetic force for facilitating the coupling of a pair of walking aids; and a second coupling assembly, which its similarly connected to a second walking aid and is magnetically attracted to the first coupling assembly such that the second coupling assembly is selectively couplable to the first coupling assembly when the first and second coupling assemblies are in close physical proximity.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
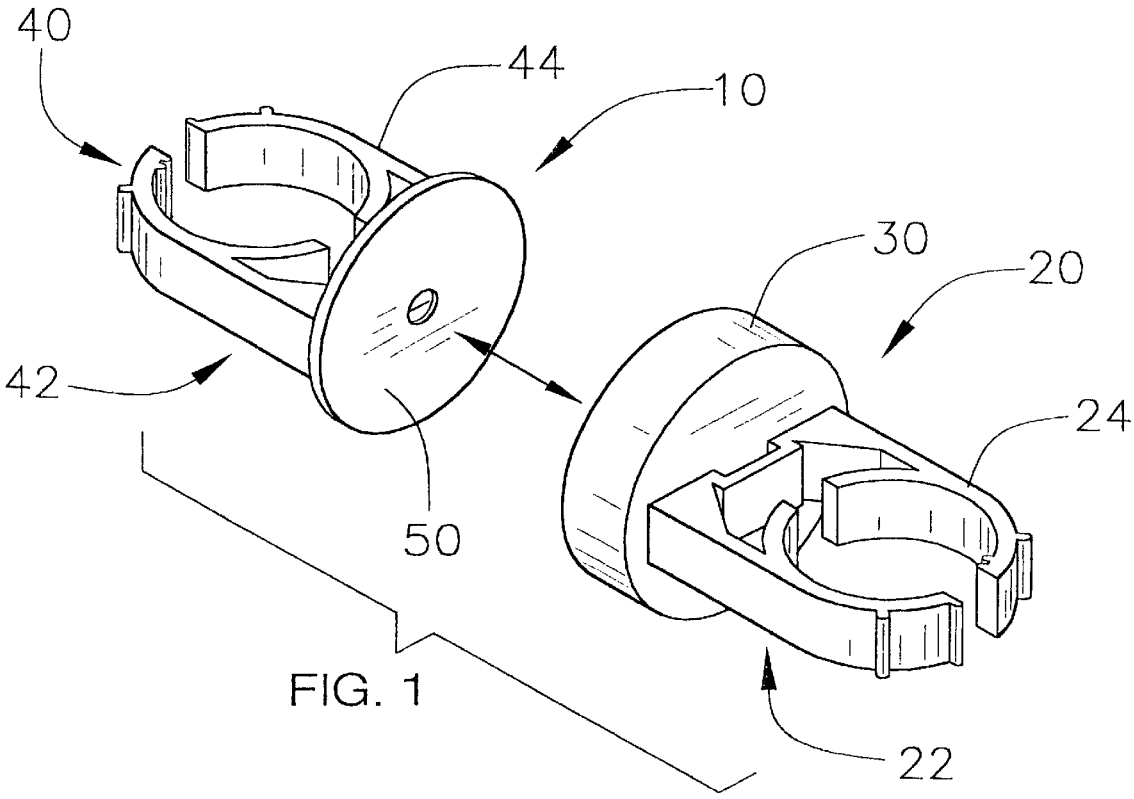
FIG. 1 is a schematic perspective view of a new crutch coupling system according to the present invention.
Figure 2:
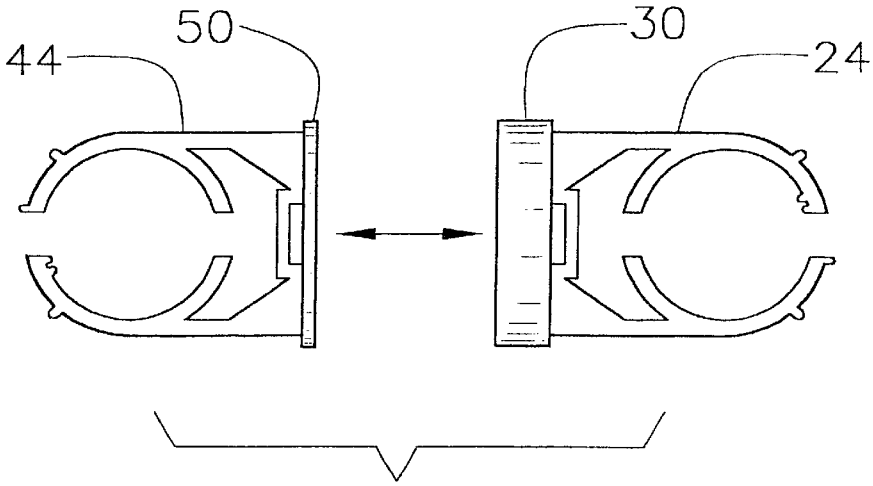
FIG. 2 is a schematic top view of the present invention.
Figure 3:
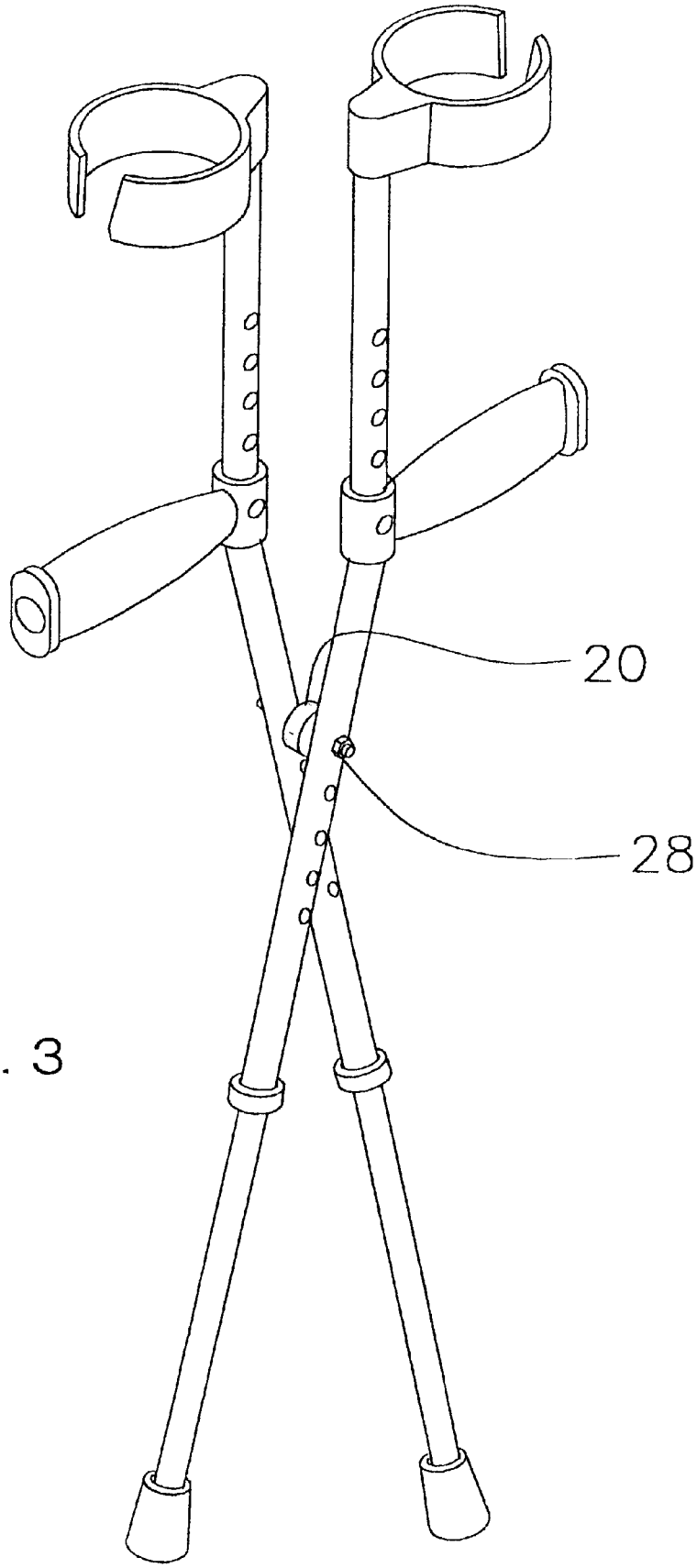
FIG. 3 is a schematic perspective view of the present invention in use.
Figure 4:
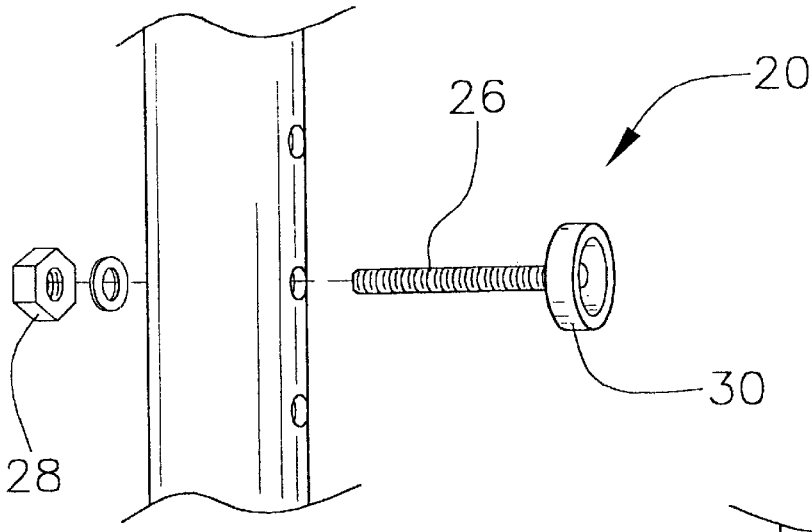
FIG. 4 is a schematic side view of the first coupling assembly of the present invention.
Figure 5:
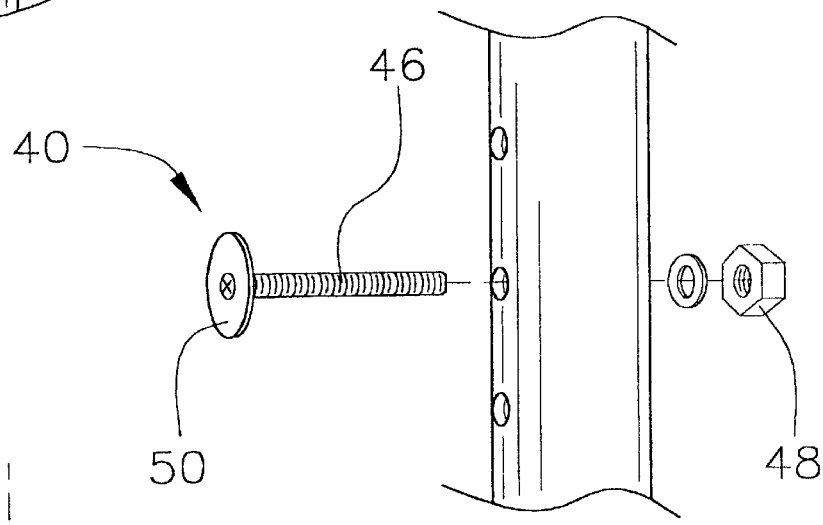
FIG. 5 is a schematic slide view of the second coupling assembly of the present invention.
Figure 6:
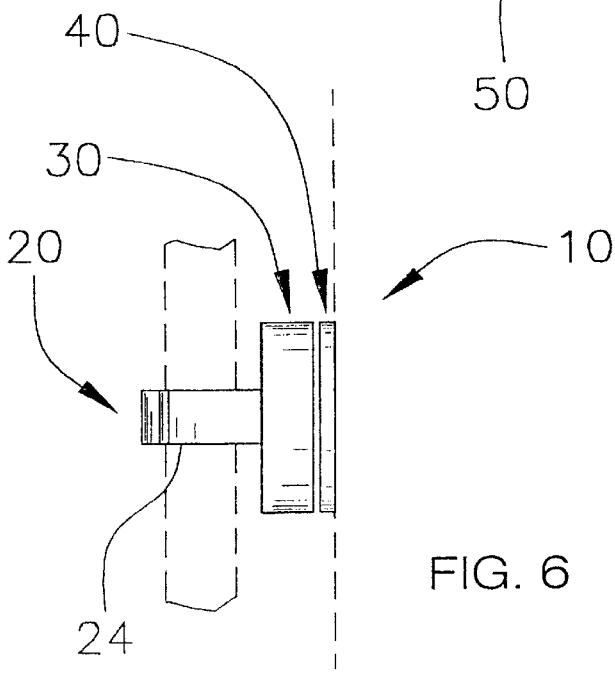
FIG. 6 is a schematic side view of an alternate embodiment of the present invention.

With reference now to the drawings, and in particular to FIGS. 1 through 6 thereof, a new crutch coupling system embodying the principles and concepts of the present invention and generally designated by the reference numeral 10 will be described.

As best illustrated in FIGS. 1 through 6, the crutch coupling system 10 generally comprises a first 20 and second coupling assemblies 40.

The first coupling assembly 20 is connected to a first walking aid. The first coupling assembly 20 provides a magnetic force for facilitating the coupling of a pair of walking aids.

The second coupling assembly 40 is connected to a second walking aid. The second coupling assembly 40 is magnetically attracted to the first coupling assembly 20 such that the second coupling assembly 40 is selectively couplable to the first coupling assembly 20 when the first 20 and second coupling assemblies 40 are in close physical proximity.

The first coupling assembly 20 further comprises a coupling portion 22 and a mating portion 30. The coupling portion 22 is designed for coupling the first coupling assembly 20 to a first one of the walking aids. The mating portion 30 is for selectively coupling the first coupling assembly 20 to the second coupling assembly 40 by magnetic attraction.

The mating portion 30 of the first coupling assembly 20 comprises a permanent magnet. The permanent magnet provides a magnetic force for facilitating coupling of the first 20 and second coupling assemblies 40.

Similarly, the second coupling assembly 40 further comprises a coupling portion 42 and a mating portion 50. The coupling portion 42 is designed for coupling the second coupling assembly 40 to a second one of the walking aids. The mating portion 50 is for selectively coupling the first coupling assembly 20 to the second coupling assembly 40 by magnetic attraction.

The mating portion 50 of the second coupling assembly 40 comprises a ferrous member. The ferrous member is attracted to a magnetic force for facilitating coupling of the first 20 and second coupling assemblies 40.

In an embodiment the coupling portion 22 of the first coupling assembly 20 comprises a clamp member 24 designed for encircling a diameter of the first walking aid.

In a further embodiment the coupling portion 22 of the first coupling assembly 20 further comprises a coupling member 26 and a securing member 28. The coupling member 26 includes a substantially cylindrical perimeter wall. The coupling member 26 is substantially elongate. The coupling member 26 includes threads applied on an exterior of the perimeter wall. The coupling member 26 can be inserted through a bore in the first walking aid. The securing member 28 also includes a bore extending through the securing member 28. The securing member 28 includes threads applied on a surface of the bore. The securing member 28 is threads onto the coupling member 26 such that when the coupling member 26 is positioned through the bore of the first walking aid the securing member 28 prevents removal of the coupling member 26.

In still a further embodiment the coupling portion 42 of the second coupling assembly 40 comprises a clamp member 44 designed for encircling a diameter of the second walking aid.

In yet a further embodiment the coupling portion 42 of the second coupling assembly 40 further comprises a coupling member 44 and a securing member 46. The coupling member 44 includes a substantially cylindrical perimeter wall. The coupling member 44 is substantially elongate. The coupling member 44 includes threads applied on an exterior of the perimeter wall. The coupling member 44 can be inserted through a bore in the second walking aid. The securing member 46 includes a bore. The securing member 46 includes threads applied on a surface of the bore. The securing member 46 threads onto the coupling member 44 such that when the coupling member 44 is positioned through the bore of the second walking aid the securing member 46 prevents removal of the coupling member 44.

In an alternate embodiment the crutch coupling system 10 is designed for use with a single conventional walking aid such as a cane and crutch. The crutch coupling system 10 comprises a first coupling assembly 20 and a second coupling assembly 40. The first coupling assembly 20 is connected to a walking aid. The first coupling assembly 20 provides a magnetic force for facilitating coupling the walking aid to a stationary object such as a table or wall. The second coupling assembly 40 is connected to the stationary object. The second coupling assembly 40 is magnetically attracted to the first coupling assembly 20 such that the second coupling assembly 40 is selectively couplable to the first coupling assembly 20 when the first 20 and second coupling assemblies 40 are in close physical proximity.

In use, each of the first and second coupling assemblies are coupled an associated one of two walking aids. When the user desires to set the walking aids aside they are coupled together by magnetic attraction providing a bipedal support for the walking aids. This can be used to hold one walking aid while the user performs a desired activity with one hand or to hold both of the walking aids in a static position when not in use.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A crutch coupling system for use with conventional walking aids comprising:

a first coupling assembly connected to a first walking aid, said first coupling assembly providing a magnetic force for facilitating the coupling of a pair of walking aids;

a second coupling assembly connected to a second walking aid, said second coupling assembly being magnetically attracted to said first coupling assembly such that said second coupling assembly is selectively couplable to said first coupling assembly when said first and second coupling assemblies are in close physical proximity.

2. The crutch coupling system of claim 1 wherein said first coupling assembly further comprises:

a coupling portion adapted for coupling said first coupling assembly to a first one of the walking aids;

a mating portion for selectively coupling said first coupling assembly to said second coupling assembly by magnetic attraction.

3. The crutch coupling system of claim 2, wherein said coupling portion comprises a clamp member adapted for encircling a diameter of the first walking aid.

4. The crutch coupling system of claim 2, wherein said coupling portion further comprises:

a coupling member having a substantially cylindrical perimeter wall, said coupling member being substantially elongate, said coupling member having threads applied on an exterior of said perimeter wall, said coupling member being insertable through a bore in the first waling aid;

a securing member having a bore extending therethrough, said securing member having threads applied on a surface of said bore, said securing member being threadedly engageable to said coupling member such that when said coupling member is positioned through the bore of the first walking aid said securing member prevents removal of said coupling member.

5. The crutch coupling system of claim 2, wherein said mating portion comprises a permanent magnet, said permanent magnet providing a magnetic force for facilitating coupling of said first and second coupling assemblies.

6. The crutch coupling system of claim 1 wherein said second coupling assembly further comprises:

a coupling portion adapted for coupling said second coupling assembly to a second one of the walking aids;

a mating portion for selectively coupling said first coupling assembly to said second coupling assembly by magnetic attraction.

7. The crutch coupling system of claim 6, wherein said coupling portion comprises a clamp member adapted for encircling a diameter of the second walking aid.

8. The crutch coupling system of claim 6, wherein said coupling portion further comprises:

a coupling member having a substantially cylindrical perimeter wall, said coupling member being substantially elongate, said coupling member having threads applied on an exterior of said perimeter wall, said coupling member being insertable through a bore in the second waling aid;

a securing member having a bore extending therethrough, said securing member having threads applied on a surface of said bore, said securing member being threadedly engageable to said coupling member such that when said coupling member is positioned through the bore of the second walking aid said securing member prevents removal of said coupling member.

9. The crutch coupling system of claim 6, wherein said mating portion comprises a ferrous member, said ferrous member being attracted to a magnetic force for facilitating coupling of said first and second coupling assemblies.

10. A crutch coupling system for use with conventional walking aids comprising:

a first coupling assembly connected to a first walking aid, said first coupling assembly providing a magnetic force for facilitating the coupling of a pair of walking aids;

a second coupling assembly connected to a second walking aid, said second coupling assembly being magnetically attracted to said first coupling assembly such that said second coupling assembly is selectively couplable to said first coupling assembly when said first and second coupling assemblies are in close physical proximity;

said first coupling assembly further comprises:

a coupling portion adapted for coupling said first coupling assembly to a first one of the walking aids;

a mating portion for selectively coupling said first coupling assemble to said second coupling assembly by magnetic attraction;

said mating portion comprises a permanent magnet, said permanent magnet providing a magnetic force for facilitating coupling of said first and second coupling assemblies;

said second coupling assembly further comprises:

a coupling portion adapted for coupling said second coupling assembly to a second one of the walking aids;

a mating portion for selectively coupling said first coupling assembly to said second coupling assembly by magnetic attraction;

said mating portion of said second coupling assembly comprises a ferrous member, said ferrous member being attracted to a magnetic force for facilitating coupling of said first and second coupling assemblies.

11. The crutch coupling system of claim 10, wherein said coupling portion of said first-coupling assembly comprises a clamp member adapted for encircling a diameter of the first walking aid.

12. The crutch coupling system of claim 10, wherein said coupling portion of said first coupling assembly further comprises:

a coupling member having a substantially cylindrical perimeter wall, said coupling member being substantially elongate, said coupling member having threads applied on an exterior of said perimeter wall, said coupling member being insertable through a bore in the first waling aid;

a securing member having a bore extending therethrough, said securing member having threads applied on a surface of said bore, said securing member being threadedly engageable to said coupling member such that when said coupling member is positioned through the bore of the first walking aid said securing member prevents removal of said coupling member.

13. The crutch coupling system of claim 10, wherein said coupling portion of said second coupling assembly comprises a clamp member adapted for encircling a diameter of the second walking aid.

14. The crutch coupling system of claim 10, wherein said coupling portion of said second coupling assembly further comprises:

a coupling member having a substantially cylindrical perimeter wall, said coupling member being substantially elongate, said coupling member having threads applied on an exterior of said perimeter wall, said coupling member being insertable through a bore in the second walking aid;

a securing member having a bore extending therethrough, said securing member having threads applied on a surface of said bore, said securing member being threadedly engageable to said coupling member such that when said coupling member is positioned through the bore of the second walking aid said securing member prevents removal of said coupling member.

15. A crutch coupling system for use with a single conventional walking aid comprising:

a first coupling assembly connected to a walking aid, said first coupling assembly providing a magnetic force for facilitating the coupling the walking aid to a stationary object;

a second coupling assembly connected to the stationary object, said second coupling assembly being magnetically attracted to said first coupling assembly such that said-second coupling assembly is selectively couplable to said first coupling assembly when said first and second coupling assemblies are in close physical proximity.

16. The crutch coupling system of claim 15 wherein said first coupling assembly further comprises:

a coupling portion adapted for coupling said first coupling assembly to a first one of the walking aids;

a mating portion for selectively coupling said first coupling assembly to said second coupling assembly by magnetic attraction.

17. The crutch coupling system of claim 16, wherein said coupling portion comprises a clamp member adapted for encircling a diameter of the first walking aid.

18. The crutch coupling system of claim 16, wherein said coupling portion further comprises:

a coupling member having a substantially cylindrical perimeter wall, said coupling member being substantially elongate, said coupling member having threads applied on an exterior of said perimeter wall, said coupling member being insertable through a bore in the first waling aid;

a securing member having a bore extending therethrough, said securing member having threads applied on a surface of said bore, said securing member being threadedly engageable to said coupling member such that when said coupling member is positioned through the bore of the first walking aid said securing member prevents removal of said coupling member.

19. The crutch coupling system of claim 16, wherein said mating portion comprises a permanent magnet, said permanent magnet providing a magnetic force for facilitating coupling of said first and second coupling assemblies.

* * * * *